United States Patent [19]

Goodrich

[11] 3,990,626

[45] Nov. 9, 1976

[54] GUSSETED PINCH BOTTOM LAMINATED PLASTIC VALVE BAG

[75] Inventor: John J. Goodrich, Pensacola, Fla.

[73] Assignee: St. Regis Paper Company, New York, N.Y.

[22] Filed: Oct. 4, 1972

[21] Appl. No.: 295,022

[52] U.S. Cl. ..... 229/55; 229/62.5

[51] Int. Cl.[2] ..... B65D 33/02; B65D 31/14

[58] Field of Search ..... 229/62.5, 55; 161/402

[56] References Cited

UNITED STATES PATENTS

| | | | |
|---|---|---|---|
| 426,607 | 4/1890 | Single | 229/62 X |
| 3,162,347 | 12/1964 | Taylor | 229/3.5 MF |
| 3,400,041 | 9/1968 | Rasmussen | 161/402 X |
| 3,549,298 | 12/1970 | Brockmuller | 229/62.5 |
| 3,650,460 | 3/1972 | Lokey | 229/62 X |

*Primary Examiner*—Stephen P. Garbe

*Attorney, Agent, or Firm*—Raymond J. McElhannon

[57] ABSTRACT

A bag of tubular form comprising at least two plies of molecularly oriented plastic film, laminated together with their directions of orientation angularly disposed to each other and to the longitudinal direction thereof, said bag having at each end thereof one surface overlapping an oppositely disposed surface, a pair of oppositely disposed gussets interposed between said surfaces, said gussets extending at said bag ends into the overlap areas between said oppositely disposed surfaces, at least one bag end including all of said overlapping portions being folded over and adhered to the oppositely disposed surface, the bag in the preferred embodiment being closed at both ends and being provided with a valve sleeve for filling.

2 Claims, 8 Drawing Figures

Fig. 5.
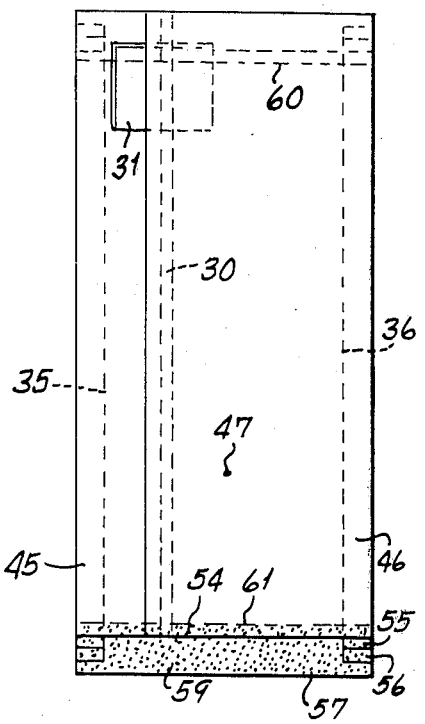
Fig. 6.
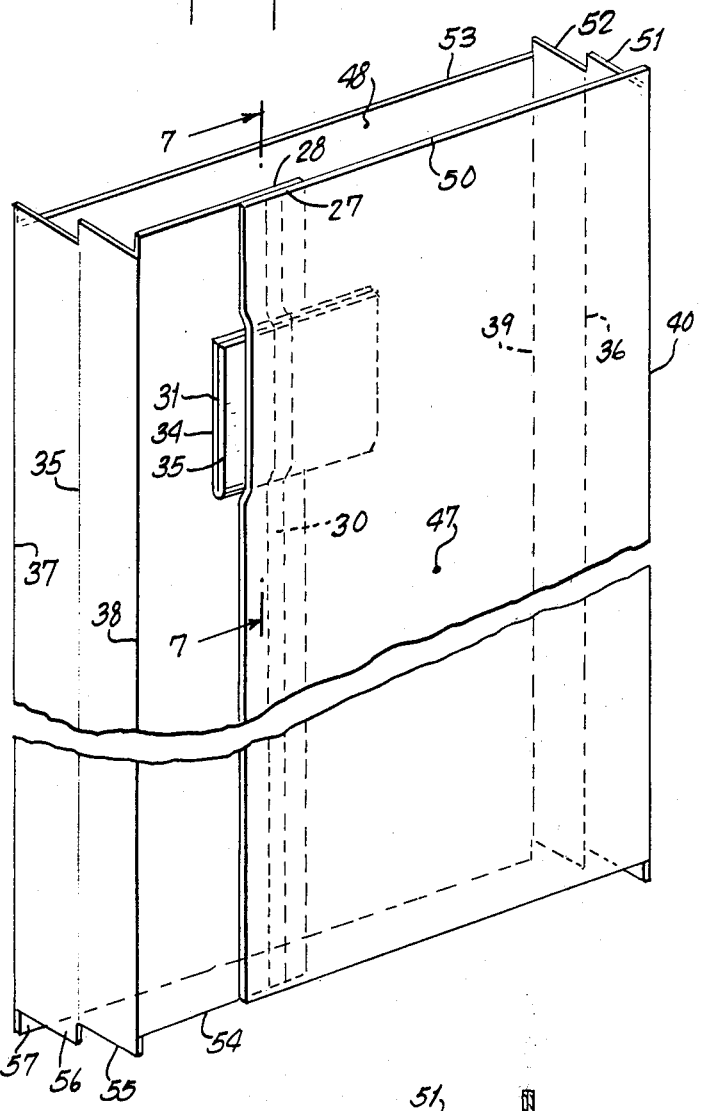
Fig. 8.
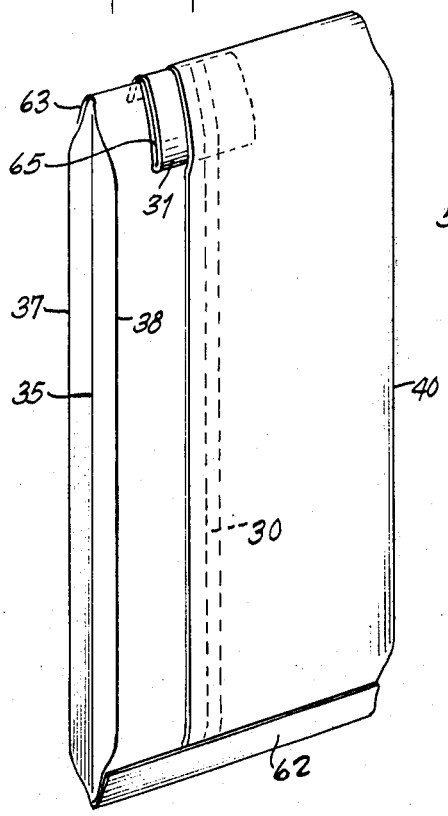
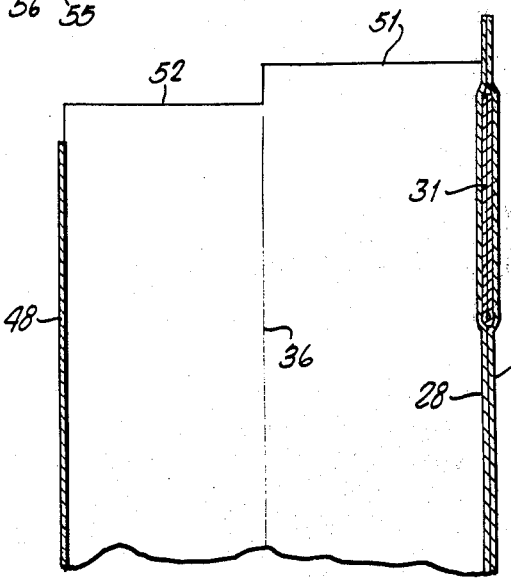
Fig. 7.

GUSSETED PINCH BOTTOM LAMINATED PLASTIC VALVE BAG

This invention pertains to bags adapted for packaging heavy loads of particulate solids, such as grain, fertilizer, chemicals, comestibles and the like, and provides a bag for such applications which is of improved puncture and impact resistance, imperviousness, tensile and rupture strength, weather resistance and lightness in weight as compared to bags previously known.

In the past, manufacturers of products shipped in bags have had to tolerate a certain rate of bag failure. Breakage rates sometimes have run as high as twenty percent, depending on such variables as distance of shipment, type of product, type of carrier and handling. Conventional multiwall kraft and low-density-polyethylene bag constructions have lacked the over-all toughness and strength required to reduce these shipping losses. In addition the best answer to date with respect to the problems of moisture and grease protection and chemical resistance has been the film/kraft combination, multi-wall bag consisting of a plurality of outer plies of kraft paper and and inner film or ply of plastic material, which nevertheless leave much to be desired as regards rupture strength, puncture and weather resistance, and freedom from sifting among other deficiencies, in common with low-density-polyethylene bags, as regards most of these defects.

The present invention overcomes these inadequacies of known bag constructions, by providing a low bulk, low weight, low cost bag construction of improved moisture resistance, grease, acid and solvent resistance, superior puncture resistance, low stretch, high tensile and tear strength, and protection against fiber, comestible and chemical contamination.

The new bag of the invention is composed of at least two plies of plastic film which is molecularly oriented to provide maximum strength in the direction of orientation, the films being cross-laminated together with their directions of orientation angularly disposed relative to one another preferably to provide substantially uniform strength in all transverse directions of the laminate. The bag is constructed in tubular form consisting in the flat state as produced, of oppositely disposed front and back surfaces between which are interposed a pair of oppositely disposed gussets, one surface at each bag end overlapping the oppositely disposed surface, with the gussets extending at each bag end into the overlap area, at least one bag end including all said overlap portions being folded over and adhered to the opposite bag surface. In the preferred construction the front and back portions of the gussets are stepped with respect to each other within said overlap area. The bag may be completed with one end open for filling, but preferably is closed at each end in the manner above stated, and is provided with a valve sleeve insert for filling.

Although there are a number of plastic materials which undergo orientation on stretching at room temperature or somewhat above, such as the linear polymers of high molecular weight, as exemplified by polyalkylenes and polyamides, or high density polypropylene or polyethylene, the preferred plastic material for the bag of this invention is a high density polyethylene film which has been stretch-oriented to more than double its tensile strength in the direction of stretch, and which is then cut on a bias, and cross-laminated in two layers in such manner that the weak direction of each component ply is overlaid by the strong direction of the opposed ply.

Having thus described the invention in general terms, reference will now be had for a more detailed description to the construction and production of a preferred embodiment thereof as made of the aforesaid, cross-laminated, polyethylene material and wherein:

FIG. 1 is an isometric view illustrating the production of the oriented, high density polyethylene film; while

FIG. 5 is a plan view and

Figure 3:
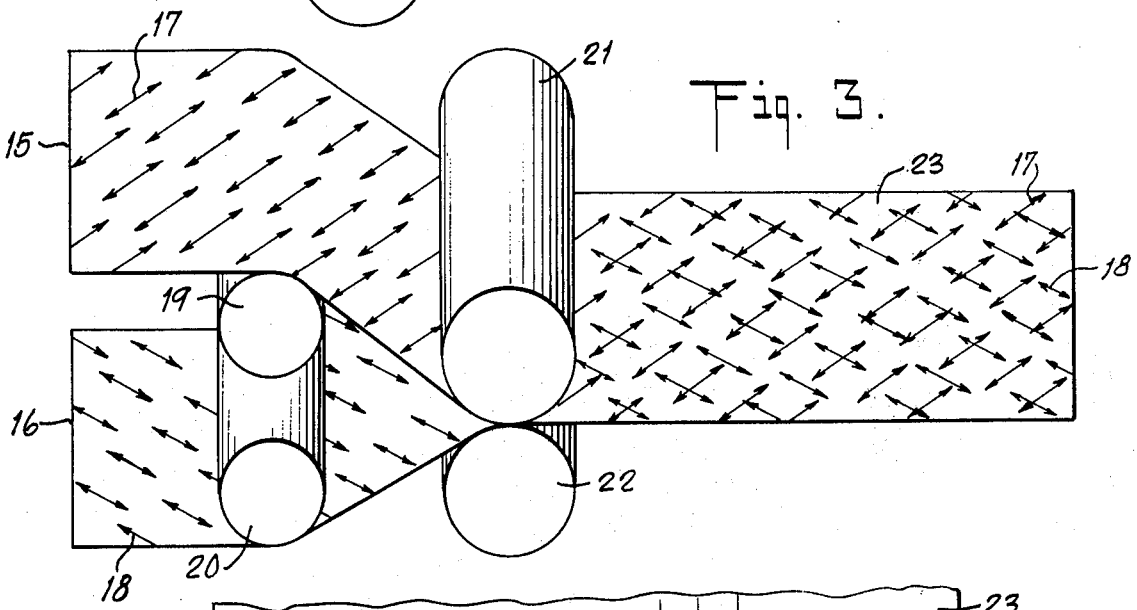
FIG. 3 is an isometric view illustrating lamination of two strips of the film as thus cut on a bias for producing the cross-laminated material for conversion into bags of the invention.

FIG. 6 an opened-up, perspective view of a tubular bag blank as produced from the perforated strip of FIG. 3.

FIG. 7 is a section at 7—7 of FIG. 6.

FIG. 8 is a perspective view of the completed bag of the invention.

Figure 1:
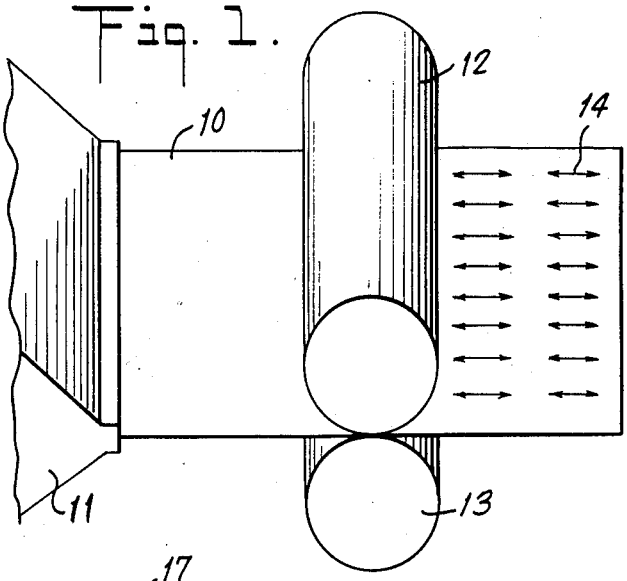

Referring to FIG. 1, a film of high molecular, high density polyethylene 10, as extruded from a die 11, is fed between a pair of rollers 12, 13, driven at such speed as to stretch the extruded film and thus orient the crystal structure longitudinally of the strip as schematically indicated at 14. The strip is then cut on a bias to the rolling direction such that the orientation will be shown at 14 of FIG. 2.

Figure 2:
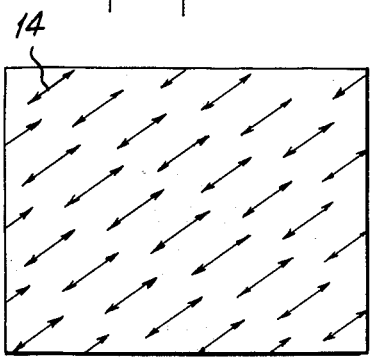
FIG. 2 illustrates in plan view a section of the oriented film as cut on a bias for two-ply lamination.

Referring to FIG. 3, two opposed lengths 15 and 16 of the oriented film strips, adhesively coated on opposed surfaces to be laminated together, and as cut on a bias as in FIG. 2, are fed in oppositely disposed directions of orientation, as at 17 and 18, respectively, over and under guide rolls 19 and 20, and thence between a pair of pressure rolls 21, 22, for lamination into two-ply, cross-laminate stock 23, in which the strong direction of orientation 17 of one ply 15, extends in the weak direction of orientation of the opposite ply 18, and vice versa. Suitable laminating bonding agents include low density polyethylene or ethylene vinyl acetate, or the like.

Figure 4:
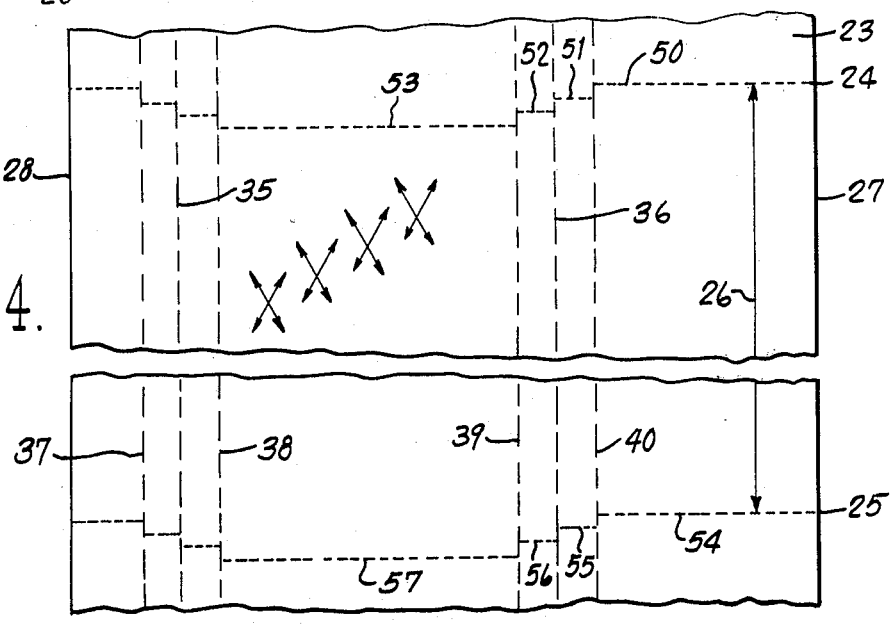
FIG. 4 is a plan view of a strip of the cross-laminated material of FIG. 3, as transversely perforated at bag lengths for forming into bags according to the invention.

The thus cross-laminated stock 23 of FIG. 3, is formed into a bag according to the invention by feeding the same through a bag tubing machine, which referring to FIG. 4, first perforates the stock transversely thereof, as at 24, 25, into bag lengths, as at 26. The perforated stock is thence fed to a tuber under which the stock is fed while the opposite longitudinal edges 27, 28, thereof, are progressively looped over the top of the tuber into overlapping relation, and the overlapped edges adhesively bonded together along a longitudinal seam, as at 30, FIGS. 5 and 6, in the manner described in U.S. Pat. No. 3,519,513, by extrusion therebetween of a hot film of a hot melt bonding agent and passage thence between a pair of pressure rolls. As pointed out in said patent the bonding agent may comprise polyvinyl-chloride or -acetate, polyethylene, polypropylene, etc.

At spaced intervals during the sealing operation, a valve sleeve comprising a folded-over rectangular section of the laminated stock, is inserted between the overlapping edges 27, 28, of the tube, as at 31, FIGS. 5 and 6, and the opposed portions 34 and 35 of the valve sleeve thus sealed to the overlapped portions 27 and 28, respectively, of the tube in the manner above described.

The bag tube thus formed, is passed thence between a pair of oppositely disposed, relatively sharp edged rolls which depress the tube inwardly along the lines 35, 36, the tube passing thence between flattening rolls, which crease the tube along lines 37, 38 and 39, 40, respectively, to form oppositely disposed gussets, as at 45, 46, FIGS. 5 and 6 interposed between the oppositely disposed surface portions 47, 48 of the tube. The tube is fed thence between pull rolls which pull the tube apart along the lines of perforations 24, 25, into tubular bag blanks constructed as shown in FIGS. 5–7 inc.

As shown in FIG. 4, the lines of perforation 24, 25, are stepped in one direction at one end of the bag blank, as at 51–53, and oppositely stepped at the opposite end, as at 54–57 inc., to provide referring more particularly to FIG. 6, for a stepping down at one end of the bag blank from the upper edge 50 of the front wall 47, to the front gusset portion as at 51, thence to the rear gusset portion as at 52, thence to the upper edge 53 of the rear wall 48; the stepping being in the opposite direction at the opposite bag end, as at 54–57 inc.

Referring to FIG. 5, an adhesive such as any of those above mentioned is applied to the overlapping portion of the bag end, as at 59, and the overlapping portions at the bag ends are then folded over along the crease lines, as at 60, 61, FIG. 5, and sealed against the opposite surface portions of the bag, as at 62, 63 of FIG. 8, thus to form the completed bag.

For purposes of filling the bag with a particulate solid material, the spout of a bag filling machine is inserted in the opening 65, FIG. 8, of the valve sleeve 31. After the bag is filled the valve sleeve opening may be sealed to closure although for most packaged materials this is not required.

Reverting to FIG. 3, the directions of orientation 17 and 18 of the laminated bag stock, are each disposed at an acute angle to the longitudinal direction of the longitudinal seam 30, of FIGS. 5–8, also to the lines of perforations 24 and 25, of FIG. 4, and to the gusset crease lines 37, 38, 39 and 40 and the fold crease lines 60, 61, of FIGS. 5, 6 and 8. Hence, in all instances of stress on the bag in use, the direction of stress is either parallel to or at an angle not greater than 45° to a strong direction of orientation in one of the laminate layers in the bag wall.

The oriented, polyethylene film employed for bags of the invention has a thickness of preferably about 2.5–4.0 mils, a specific gravity of about 0.8–0.85, a tensile strength of about 8,000 psi, a water absorption in 24 hours of less than 0.01%, and superior chemical resistance to most strong acids and bases.

Bags according to the invention have an impact resistance about ten times that of four- and five-ply, multi-wall kraft bags, and in drop tests to failure, a rupture strength at least double that of such multi-wall bags, and a puncture resistance at least five times greater.

What is claimed is:

1. A bag composed of two plies of high density polyethylene film having a specific gravity of about 0.8–0.85, said film being stretch-oriented to a tensile strength of at least 8000 psi in the direction of orientation, said plies being laminated together with their directions of orientation angularly disposed to provide a flexible laminate of increased and substantially uniform tensile strength in all directions of applied tension, said laminate being formed into a tube with overlapping longitudinal edges sealed together with a hot melt thermoplastic adhesive into a longitudinal seam, and with the directions of orientation of each of said plies disposed at an acute angle to the direction of said seam, said tube having formed therein a pair of oppositely disposed gussets interposed between oppositely disposed front and back surface portions, one surface portion overlapping the other at each end of said tube, said gussets terminating in said overlap portion at each said end and with the rear portion of each gusset stepped up with respect to the front portion thereof to form exposed stepped, front and rear portions thereof, one said tube end including said overlap portion and said exposed gusset portions being folded over and bonded to the opposite surface portion of said tube with said hot melt thermoplastic adhesive.

2. A bag according to claim 1 wherein the opposite end of said tube is the reverse of that of said one end and is folded over and adhered to the oppositely disposed surface of said tube with said hot melt thermoplastic adhesive, and wherein a valve sleeve is inserted between said overlapping longitudinal edges of said tube with opposite surfaces of said sleeve sealed to said edges, respectively, with said hot melt adhesive.

* * * * *